United States Patent [19]

Magnusson

[11] Patent Number: 4,621,481

[45] Date of Patent: Nov. 11, 1986

[54] CLOSURE HEAD FOR SECURING A SEALING CAP TO A CONTAINER

[75] Inventor: Sven-Ake Magnusson, Kungalv, Sweden

[73] Assignee: Wicanders AB, Alvangen, Sweden

[21] Appl. No.: 751,246

[22] Filed: Jul. 2, 1985

[30] Foreign Application Priority Data

Jul. 31, 1984 [JP] Japan ..... 59-159441

[51] Int. Cl.[4] ..... B67B 3/14; B65B 7/28

[52] U.S. Cl. ..... 53/345; 53/356

[58] Field of Search ..... 53/344, 345, 346, 347, 53/351, 352, 353, 355, 356, 357

[56] References Cited

U.S. PATENT DOCUMENTS

| | | | |
|---|---|---|---|
| 2,339,119 | 1/1944 | Thomas | 53/352 X |
| 2,452,934 | 11/1948 | Kantor | 53/351 X |
| 2,963,835 | 12/1960 | Clift | 53/351 X |
| 3,672,121 | 6/1972 | Kawaminani | 53/351 |

FOREIGN PATENT DOCUMENTS 15089 1/1984 Japan .

*Primary Examiner*—E. R. Kazenske
*Assistant Examiner*—Michael D. Folkerts
*Attorney, Agent, or Firm*—Brumbaugh, Graves, Donohue & Raymond

[57] ABSTRACT

A closure head for securing a sealing cap having a disc-like top and a cylindrical skirt to a container comprises a central plunger slidable in a counter-pressure plunger between extended and retracted positions with respect thereto, a spring normally urging said central plunger to the extended position, a closure sleeve composed of a plurality of arms surrounding the counter-pressure plunger, each having at the free end thereof a clamp shoe provided with an inwardly projecting clamp rim and a radially outwardly directed inclined surface, a support sleeve for carrying said counter-pressure plunger and closure sleeve, a casing surrounding the support sleeve and supporting the latter therein, said casing being provided with a wear ring having an inclined surface in sliding contact with the inclined surfaces on the clamp shoes for closing the container upon sliding movement of the inclined surfaces of the clamp shoes along the wear ring, and the inwardly projecting clamp rim at the end of said each arm forming the clamp shoe being provided at its nearly center portion with a concave recess for forming projections spaced apart from each other at given distance around the skirt of the cap for closing the container.

4 Claims, 7 Drawing Figures

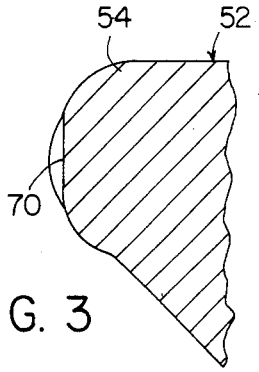
FIG. 3
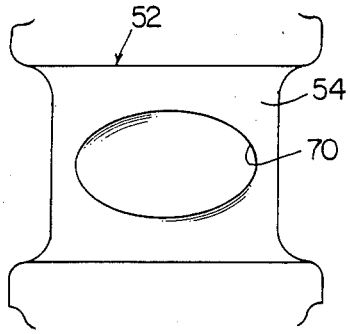
FIG. 4
FIG. 5
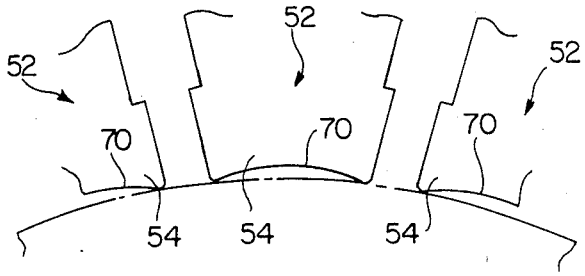
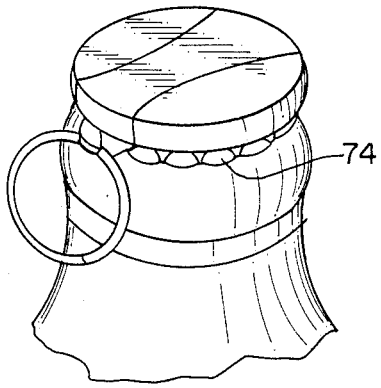
FIG. 6

CLOSURE HEAD FOR SECURING A SEALING CAP TO A CONTAINER

BACKGROUND OF THE INVENTION

This invention relates to a closure head for securing a sealing cap of the kind having a top surface, a skirt, and tear tab to a bottle opening. More particularly, this invention relates to a closure head of this general character which is capable of securing a sealing cap to a bottle opening effectively without the formation of wrinkles in the cap skirt portion.

There has previously been known a closure head for a cap which comprises a vertically slidable support sleeve arranged in a casing, a vertically movable counter-pressure plunger secured to said support sleeve, and a closure sleeve, said counter-pressure plunger being provided therethrough with a central plunger, said closure sleeve being surrounded by a pressure plunger, the upper portion of which is connected to a support ring secured to the casing and portion holds a wear ring, said closure sleeve at its lower end forming an inclined face at its outer periphery while forming at its inner periphery a fastening shoe provided with a fastening projection, said inclined face being contacted with said wear ring for sliding the latter, thereby allowing the fastening projection of the shoe to urge the skirt portion of the cap against the bottle neck to effect closure of the bottle.

In closure heads of this type, several of the closure components are rigidly connected to each other so that fine adjustment of the closure head relative to the bottle opening is difficult and damage to the bottle may occur during the closure operation. Such damage may be due to improper size or location of the bottle during the closure operation. Various adjusting mechanisms have been developed and proposed in an effort to overcome such difficulties. Especially, the applicant has developed a novel mechanism for automatically matching the sliding movement between the inclined face and the wear ring with variation of the closure operation, as disclosed in Japanese Patent Application No. 117770/82, laid-open No. 15089/84.

The closure head according to the above patent application, in which freedom of engagement between the fastening shoe of the closure sleeve and the bottle neck is large enough to solve the problems of bottle damage and poor closure of the cap during the operation, is found to be excellent. However, a common problem with such closure heads is that they tend to generate irregular wrinkles at the lower edge of the skirt, thereby forming a gap due to pressure of the fastening shoe in urging the skirt against the bottle neck, which gap may result in a poor closure and poor protection from dust entering the bottle through the gap.

An object of the invention, therefore, is to provide a new and improved closure head of the above character in which the freedom of engagement between the closure head and the bottle neck is increased so that bottle damage and poor closure are avoided, and irregular wrinkle formation in the cap skirt is prevented.

SUMMARY OF THE INVENTION

The above object may be achieved in accordance with the invention by providing a cylindrical closure head for securing a sealing cap to a container comprising a central plunger slidable in a counter-pressure plunger between extended and retracted positions with respect thereto, a spring normally urging said central plunger to the extended position, a closure sleeve composed of a plurality of arms surrounding the counter-pressure plunger, each having at the free end thereof a clamp shoe provided with an inwardly projecting clamp rim and a radially outwardly directed inclined surface, a support sleeve for carrying said counter-pressure plunger and closure sleeve, a casing surrounding the support sleeve and supporting the latter therein, and said casing being provided with a wear ring having an inclined surface in sliding contact with the inclined surfaces on the clamp shoes for closing the container upon slidable movement of the inclined surface of the clamp shoe along the wear ring. The inwardly projecting clamp rim at the end of said each arm forming the clamp shoe is provided at its nearly center portion with a concave recess for forming projections spaced apart from each other at a given distance around the skirt of the cap for closing the container.

Also, according to the invention, the front end of each arm forming the clamp shoe is preferably formed at its inner surface with a guide incline, a clamp rim part continuing to the guide incline to exert a closing pressure against the cap skirt in the closing operation and a recess continuing to the clamp rim.

Further, in accordance with the invention, the concave portion provided at the nearly center portion of the clamp rim may be positioned correspondingly to a lower edge of the cap skirt or to an upper position of the cap skirt, as desired.

DESCRIPTION OF A PREFERRED EMBODIMENT

The invention is described hereinbelow in greater detail with reference to the accompanying drawings, in which:

FIG. 3 is an enlarged sectional view of part of a fastening shoe on the closure sleeve shown in FIGS. 1 and 2;

FIG. 4 is a front view of the fastening shoe portion shown in FIG. 3;

FIG. 5 is a schematic plan view of several fastening shoes of the type shown in FIGS. 3 and 4 in closing relation to a bottle cap skirt; and FIGS. 6 and 7 are different perspective views of a cap mounted on a bottle opening by apparatus in accordance with the invention.

Figure 2:
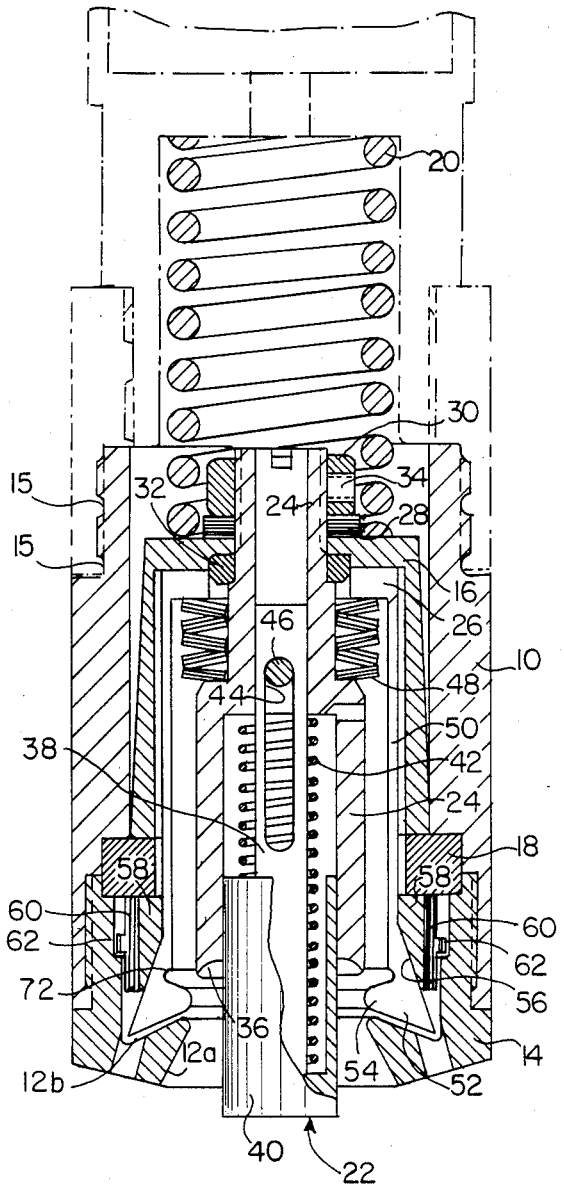
FIG. 2 is a schematic sectional view of one embodiment of closure head according to the invention incorporating the closure sleeve shown in FIG. 1.
Figure 7:
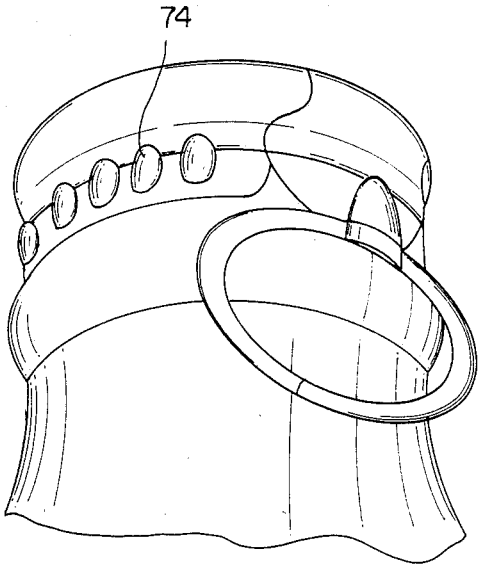

Referring first to FIG. 2, the closure head comprises a casing 10 formed as a thick-walled metal cylinder threaded at its lower portion to a guide ring 14 having an inclined wall 12*a* to form a conical guide opening. At its upper end, the casing is provided with a groove 15 enabling it to be secured to closure head supporting means (not shown). Slidably disposed in the casing 10 is a truncated conical support sleeve 16 the lower end of which rests on a support ring 18 fitted in a groove formed in the casing 10 and the guide ring 14 where they are joined together. A spring 20 disposed in a spring housing (not shown) formed at the upper portion of the casing 10 urges the support sleeve 16 downwardly.

Centrally disposed within the support sleeve 16 are a center plunger 22, a counter-pressure plunger 24 through which the center plunger 22 passes, and a closure sleeve 26 surrounding the counter-pressure plunger 24.

The counter-pressure plunger 24 comprises an upper constricted portion and a lower enlarged portion. The constricted portion passes through an opening in the upper wall of the support sleeve 16 and is fixed to the top of the latter by means of a washer 28 and a nut 30, and to its underside by a spacer 32 inserted in a groove at the joint portion. Spacers 32 of different sizes may be provided, from which a selection may be made according to the bottle height for positioning the lower end of the counter-pressure plunger 24 at a suitable position. Threaded engagement of the nut 30 with the constricted portion of the counter-pressure plunger is accomplished by a stop pin 34 through a threaded hole in the nut 30. The counter-pressure plunger 24 is provided with a curved face 36 at its enlarged lower end to receive the top of a cap in a closing operation.

The center plunger 22 comprises a thin shaft 38 slidable within the constricted portion of the counter-pressure plunger 24, the lower end of which is secured to a sleeve 40 closed at its lower end and slidable in the enlarged portion of the counter-pressure plunger 24. The sleeve 40 and the lower end of the thin shaft 38 secured thereto form an assembly in which is housed a spring 42. At its upper end, the spring 42 is seated against an inner face of a stepped portion of the counter-pressure plunger 24, while its lower end rests against the bottom of the sleeve 40, which is located slightly below the lower end of the guide ring 14. The thin shaft 38 at its upper portion is provided with an axially directed elongated slot 44, through which extends a pin 46 secured in the counter-pressure plunger 24 so as to allow the thinshaft 38 to slide vertically without rotation. The sleeve 40 is slightly shorter in length than the enlarged portion of the counter-pressure plunger 24, as shown in FIG. 2.

Figure 1:
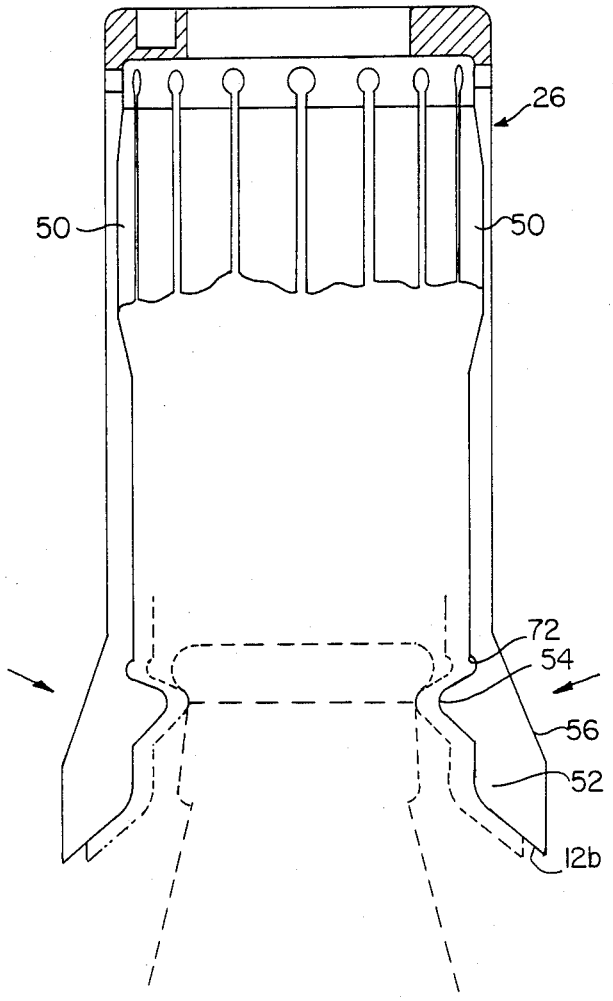
FIG. 1 is a partially broken sectional view of a closure sleeve having fastening shoes constructed according to the invention.

At its upper end, the closure sleeve 26 extends radially inwardly at right angles and its upper face is maintained in contact with the underside of the support sleeve 16 by a suitable spring 48 interposed between the underside of the support sleeve 16 and the stepped portion of the counter-pressure plunger 24. The spring 48 may be a dish spring or a coil spring, for example. As shown in FIG. 1, the closure sleeve 26 comprises a plurality (usually about 16 - 24) of closure arms 50, each of which has at its free end a cap fastening shoe 52 having a radially inward fastening projection 54 and a radially outward inclined face 56.

In a space defined by the inclined faces 56 of the fastening shoes 52, the guide ring 14 and the support ring 18 are disposed a wear ring 58 and a retaining ring 60 contacted therewith. The wear ring 58 is supported in the retaining ring 60 and has an inclined inner face which is slidably contacted with the inclined faces 56 of the fastening shoes 52. The retaining ring 60 at a middle portion of its outer face is provided with a projection 62 which is contacted with a groove in the guide ring 14. The upper faces of the wear ring 58 and the retaining ring 60 are in contact with an underface of the support ring 18. The wear ring 58 may be made of a suitable plastic material having a low frictional coefficient, e.g., less than 0.1 of water lubrication, and a high hardness number, e.g., a Rockwell hardness number greater than 120. Preferably, a formaldehyde plastic, such as the product marketed under the trademark DELRIN, is utilized. The retaining ring 60 is preferably made of a stainless steel.

As shown in FIGS. 3 to 5, the fastening projection 54 on each of the cap fastening shoes 52 at the free end of the closure arms 50 has formed in its center projected portion a recess 70 having an oblong profile as seen from the front. The recesses 70 are of such size that when the cap skirt is urged against the bottle neck by means of the fastening shoes 52 in a closure operation, the portions of the cap skirt may be outwardly expanded to prevent the occurrence of wrinkles at its lower edge. Further, each fastening shoe 52 at its lower portion engages an inclined guide portion of the guide ring 14 so that the latter may be threaded into a lower portion of the casing 10 to form a cylindrical casing. Each fastening shoe 52, on the other hand, is provided with a guide inclination **12*b* to form a conical opening, and with the aforesaid fastening projection 54 and a recess 72 adjacent to the guide inclination 12*b***.

In operation, the closure head is suspended from a supporting means (not shown) and operated by an operational mechanism (not shown) to move towards a position above a bottle to which a cap has previously been fed in the known manner for effecting a closure operation. As the closure head is lowered vertically towards the bottle, the center plunger 22 first engages the top face of the cap. During continued lowering of the head, the cap is urged against the bottle by means of the spring 42, while the plunger 22 is pushed inside the counter-pressure plunger 24 until the lower end face of the latter is introduced into the curved face 36. The pressure of the spring 42 is weak, so that the center plunger 22 may be adjusted to align with the center of the cap and the bottle by means of the inclined guide face **12*a*. As lowering of the closure head continues, the center plunger 22 and the lower end face 36 of the counter-pressure plunger 24 urge the cap against the bottle with a pressure applied by the spring 20, thereby lifting the closure sleeve 26 and the support sleeve 16 together. This lifting movement causes the inclined guide faces 56 of the fastening shoes 52 to be moved radially inward in sliding relation to the wear ring 58. As a result, the projections 54 on the fastening shoes 52** apply closing pressure to the cap skirt to fix the latter to the bottle opening along its bead.

Since the center recesses 70 of the projections 54 are located in circumferentially spaced relation to the skirt, the corresponding portion of the latter cannot be fabricated but forms wavy undulations 74 expanded outwardly, as shown in FIG. 6 and prevents the fastening shoes 52 from sliding sideways relatively the skirt. When two shoes slide apart, the opening between them can be big enough to allow the skirt to bend out and form a wrinkle. Thus, occurence of irregular wrinkles on the lower edge of the cap skirt may be surely prevented. While in the embodiment shown in FIG. 6 the undulations 74 have been formed on the lower edge of the skirt, they may be formed on the upper portion of the skirt to prevent the occurence of wrinkles.

In accordance with the closure head of the invention, a slightly deviated center line may be correctly adjusted by inclining the support sleeve 16 in alignment with the center line together with inclination of all elements supported by the support sleeve 16, thereby to deviate the wear ring 58 radially through the retaining ring 60 and axially through the support ring 18. The irregular force component due to the deviation of the center line is absorbed by the plate spring 48 to prevent irregular action on the bottle neck. Further, since sixteen or more closure arms 50 are usually provided, the irregular force component due to the oblong shape of the bottle opening may be absorbed by deviation of each arm 50 and the weak retaining ring 60 supporting each arm 50.

It will be appreciated from the above that the closure head according to the invention may absorb the abnormal closure pressure to prevent irregular action so that any cap material from strong metal to soft plastic may be utilized and thus may be suitably used for closing caps of large diameter.

By virtue of the oblong recesses 70 formed in the projections 54 of the fastening shoes 52, portions of the cap skirt may be outwardly expanded to surely prevent occurrence of wrinkles at the lower edge of the skirt. As a result, sealability of the closed cap to the bottle neck may be improved, while the urging pressure of the fastening shoe 52 on the bottle neck may be alleviated to reduce the risk of its damage, thus considerably improving the workability and the safety of operation. Also, the recesses 70 in the projections 54 and the recesses 72 slightly thereabove may enhance deformation of the cap material suitably during the closure operation.

The wavy undulation formed on the cap skirt in accordance with the invention preferably consists of about sixteen rugged portions, i.e. one for each fastening shoe, on the skirt circumference of a cap having a diameter of about 2.5–3.0 cm, for example. If these rugged portions are provided along the lower edge of the skirt as shown in FIG. 6, gaps formed between these portions and the bottle neck may facilitate drainage and drying of the lower edge portion upon the closure operation, thereby preventing rusting.

It will be understood that the closure head according to the invention can be very conveniently assembled or disassembled. Thus, anti-clockwise rotation of the guide ring 14 may readily release the threaded engagement with the casing 10, thereby to enable all elements in the casing to be removed sequentially and the wear ring 58 to be conveniently replaced. Other advantages, such as the prevention of damage to the bottle and loss of the caps, as well as improvement in the operation, the low manufacturing cost of the apparatus and convenience in repair thereof, and its effectiveness in continuous closure operation with tear tabs, may be achieved.

Although the invention has been described hereinabove with reference to the preferred embodiments, it will be appreciated that many variations and modifications may be made without departing from its spirit and scope.

I claim:

1. A closure head for securing a sealing cap having a disc-like top and a cylindircal skirt to a container comprising a central plunger, slidable in a counter-pressure plunger between extended and retracted positions with respect thereto, a spring normally urging said central plunger to the extended position, a closure sleeve composed of a plurality of arms surrounding the counter-pressure plunger, each having at the free end thereof a clamp shoe provided with an inwardly projecting clamp rim and a radially directed inclined surface, a support sleeve for carrying said counter-pressure plunger and closure sleeve, a casing surrounding the support sleeve and supporting the latter therein, said casing being provided with a wear ring having an inclined surface in sliding contact with the inclined surface on the clamp shoes for closing the container upon sliding movement of the inclined surfaces of the clamp shoes along the wear ring, characterized in that each inwardly projecting clamp rim has a recess extending thereinto from the surface thereof, said recesses being circumferentially spaced to provide projections around the skirt of a cap when it is being secured to a container by sliding movement of said inclined surfaces along said wear ring.

2. A closure head according to claim 1 further comprising a circumferential groove in the inner side of each clamp shoe above the clamp rim thereof, an upper upwardly and outwardly inclined surface extending from the clamp rim to the recess of each clamp shoe, and a lower upwardly and inwardly inclined surface on each said clamp shoe extending to the clamp rim thereof, the lower inclined surfaces of said clamp shoes defining a conical opening to receive a cap on a container in a closing operation.

3. A closure head according to claim 1 or 2 wherein the recess in each of said clamp rims is elongated in the circumferential direction and is positioned so as to form said cap projections near a lower edge of the cap.

4. A closure head according to claim 1 or 2 wherein the recess in each of said clamp rims is elongated in the circumferential direction and is positioned so as to form said cap projections near an edge of the cap.

* * * * *